US008302269B2

(12) United States Patent
Pitman

(10) Patent No.: US 8,302,269 B2
(45) Date of Patent: Nov. 6, 2012

(54) FASTENING DEVICE

(75) Inventor: Raymond Pitman, Berkhamsted (GB)

(73) Assignee: Talon International, Inc., Woodland Hills, CA (US)

( * ) Notice: Subject to any disclaimer, the term of this patent is extended or adjusted under 35 U.S.C. 154(b) by 213 days.

(21) Appl. No.: 12/733,608

(22) PCT Filed: Sep. 4, 2008

(86) PCT No.: PCT/GB2008/050785

§ 371 (c)(1),
(2), (4) Date: Mar. 10, 2010

(87) PCT Pub. No.: WO2009/034378

PCT Pub. Date: Mar. 19, 2009

(65) Prior Publication Data

US 2010/0287747 A1 Nov. 18, 2010

(30) Foreign Application Priority Data

Sep. 10, 2007 (GB) ..... 0717581.3

(51) Int. Cl.
*A41F 1/00* (2006.01)

(52) U.S. Cl. ..... 24/591.1; 24/666

(58) Field of Classification Search ..... 24/591.1, 24/701, 695, 114.05, 114.4, 578.1, 578.12, 24/662, 666, 465, 667, 698.1, 578.14, DIG. 46, 24/594.1, 594.11, 596.1; 450/14, 104, 36, 450/63, 12, 17, 23, 26, 28, 33, 58, 79, 80; 2/96, 336

See application file for complete search history.

(56) References Cited

U.S. PATENT DOCUMENTS 1,205,247 A * 11/1916 Munroe ..... 24/594.1
(Continued)

FOREIGN PATENT DOCUMENTS

DE 2606576 A1 8/1977
(Continued)

OTHER PUBLICATIONS

International Search Report, Form PCT/ISA/210, 2 pages, for International Application No. PCT/GB2008/050785 completed on Apr. 17, 2009 and mailed May 7, 2009.

*Primary Examiner* — Robert J Sandy
*Assistant Examiner* — Rowland D Do
(74) *Attorney, Agent, or Firm* — Davidson Berquist Jackson & Gowdey, LLP; Brian Siritzky

(57) ABSTRACT

A fastening device includes a first female component and a second male component, each component adapted for attachment to a back panel, wing or strap of a garment or the like, the first component includes a plastic first plate having an inner side and an outer side. The second component includes a second plastic plate having an inner side and an outer side adapted to at least partially overlie the outer side of the first plate in use. The first plate is formed with a plurality of connecting recesses and the inner side of the second plate is formed with at least one connecting protrusion adapted to be releasably received and retained selectively in any one of the connecting recesses. The second plate is formed with a resilient nose inclined downwardly in the direction from its outer side towards its inner side and is deflected upwardly when the components are coupled together to bear resiliently against the outer side of the first plate.

20 Claims, 6 Drawing Sheets

U.S. PATENT DOCUMENTS

| | | | | |
|---|---|---|---|---|
| 3,200,464 | A * | 8/1965 | Cousins | 24/593.1 |
| 3,418,700 | A | 12/1968 | Edelman | |
| 3,837,049 | A * | 9/1974 | Corrado | 450/82 |
| 4,183,121 | A * | 1/1980 | Cousins | 24/588.1 |
| 4,204,300 | A * | 5/1980 | Fildan | 24/578.1 |
| 5,427,562 | A * | 6/1995 | Hwang | 450/58 |
| 5,485,658 | A * | 1/1996 | Fildan | 24/614 |
| 5,784,765 | A * | 7/1998 | Fildan | 24/615 |
| 6,233,793 | B1 * | 5/2001 | Wanzenbock | 24/615 |
| 6,321,419 | B1 | 11/2001 | Fildan et al. | |
| 6,536,085 | B1 * | 3/2003 | Milano | 24/580.11 |
| 2003/0115727 | A1 * | 6/2003 | Yokozeki et al. | 24/591.1 |
| 2005/0015946 | A1 * | 1/2005 | Downing et al. | 24/701 |
| 2005/0251970 | A1 | 11/2005 | Fildan et al. | |
| 2008/0295304 | A1 * | 12/2008 | Gardner | 24/702 |
| 2010/0101058 | A1 * | 4/2010 | Fildan et al. | 24/578.14 |

FOREIGN PATENT DOCUMENTS

| | | | |
|---|---|---|---|
| EP | 0084747 | A1 | 11/1982 |
| EP | 1348349 | A1 | 10/2003 |
| GB | 679373 | | 9/1952 |
| GB | 2398825 | A | 9/2004 |
| GB | 2420586 | A * | 5/2006 |
| GB | 2435070 | A * | 8/2007 |
| WO | WO 00/69300 | | 11/2000 |
| WO | WO 2007/091025 | A1 | 8/2007 |

* cited by examiner

FASTENING DEVICE

The invention relates to a fastening and is intended primarily for a brassiere or similar garment but may find application in other areas.

BACKGROUND OF THE INVENTION

The typical fastening for the two rear panels or wings of a brassiere comprises two or more rows of metal eyes embedded in one panel and corresponding hooks attached to the other panel. These metal elements can easily assume positions where they dig into the body of the wearer to cause discomfort. Also the two textile panels are relatively thick and, when fastened, they overlap causing an unsightly bulge under outer clothing.

It has been proposed to replace the metal hooks and eyes with a pair of interconnecting plastic plates. WO 2007/091025 describes an adjustable fastener which includes a male component and a female component both of which are made of soft pliable plastic which can be connected to textile material. The female component has three spaced apart openings. The male component has a protrusion which acts as a hook when inserted into one of the openings in the female recess and slid into position. One disadvantage of this fastener is that the nose of the male component which overlies the female component when the fastener is connected tends to move slighting away from the female component when the fastener is under tension. This "lift" opens a gap which reduces the ability of the fastener to lie under a garment with little or no visible sign.

SUMMARY OF THE INVENTION

The invention provides a fastening comprising a first, female component and a second, male component, each component being adapted for attachment to a back panel, wing or strap of a garment or the like, wherein the first component comprises: a plastic first plate which has an inner side and an outer side, wherein the second component comprises a second plastic plate which has an inner side and an outer side adapted to at least partially overlie the outer side of the first plate in use; wherein the first plate is formed with a plurality of connecting recesses and wherein the inner side of the second plate is formed with at least one connecting protrusion adapted to be releasably received and retained selectively in any one of the connecting recesses; wherein the second plate is formed with a resilient nose which is inclined downwardly in the direction from its outer side towards its inner side and is deflected upwardly when the components are coupled together to bear resiliently against the outer side of the first plate.

In a second aspect of the invention, the inner face of the first plate has a raised area surrounding each recess, the raised areas having areas of reduced thickness therebetween.

In a third aspect, the recesses comprise an open portion and a covered portion and the surrounding wall of at least the covered portion is provided by a raised area surrounding the recess.

Embodiments of the invention are described below.

DETAILED DESCRIPTION

Figure 1:
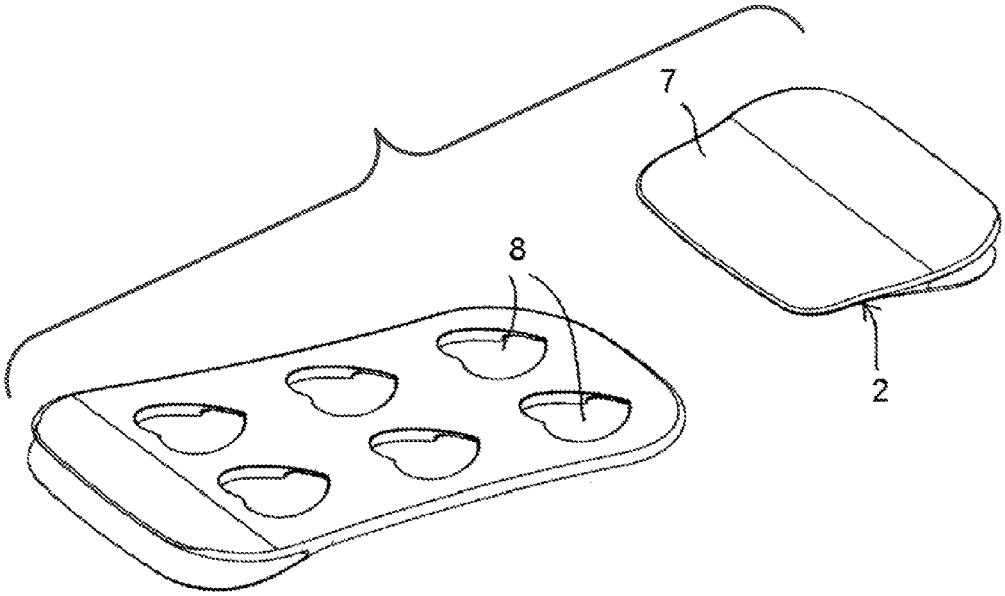
FIG. 1 is a perspective view of a fastening from above.
Figure 2:
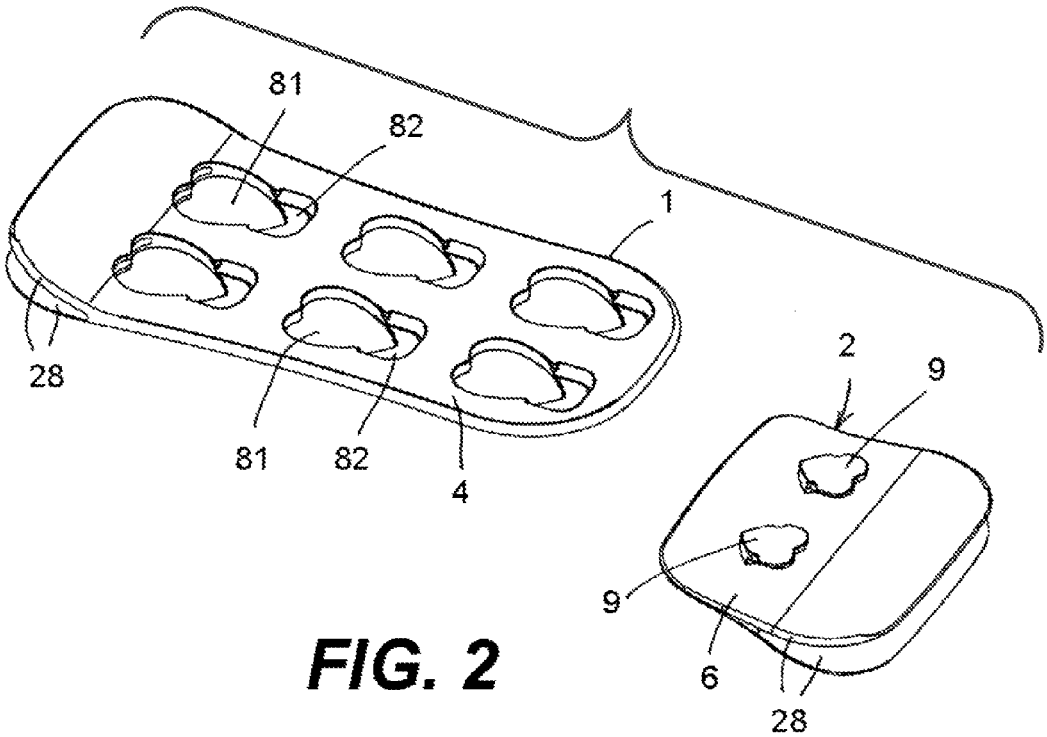
FIG. 2 is a perspective view of a fastening from below.
Figure 3:
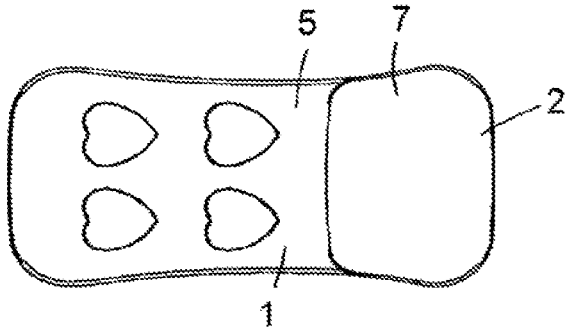
FIG. 3 is a plan view of a fastening.
Figure 4:
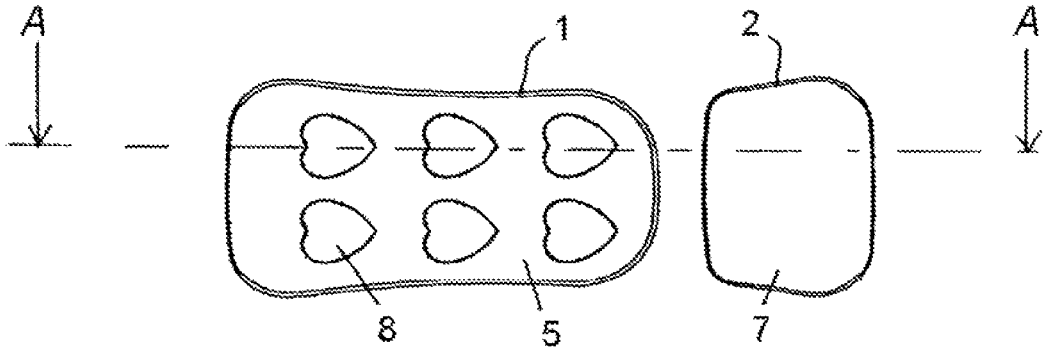
FIG. 4 is a plan view of the components of a fastening.
Figure 5:
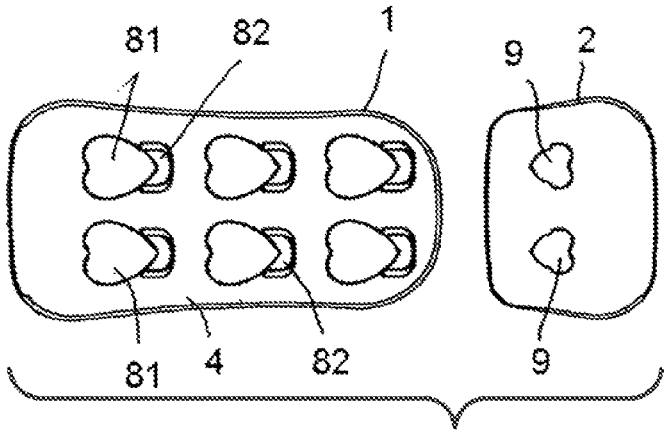
FIG. 5 is an underplan view of the components of a fastening.
Figure 6:
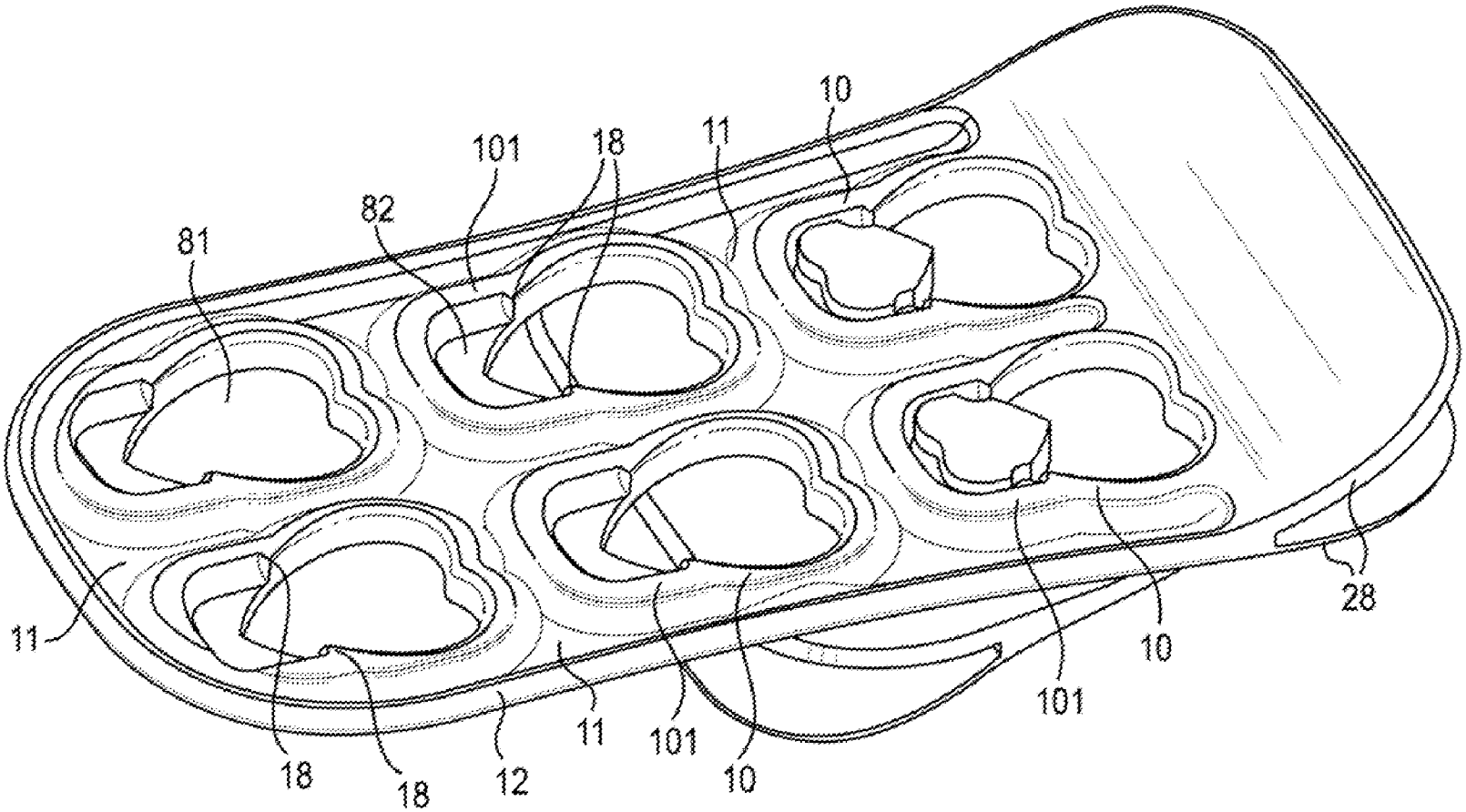
FIG. 6 is a more detailed perspective view of a fastening from below.
Figure 7:
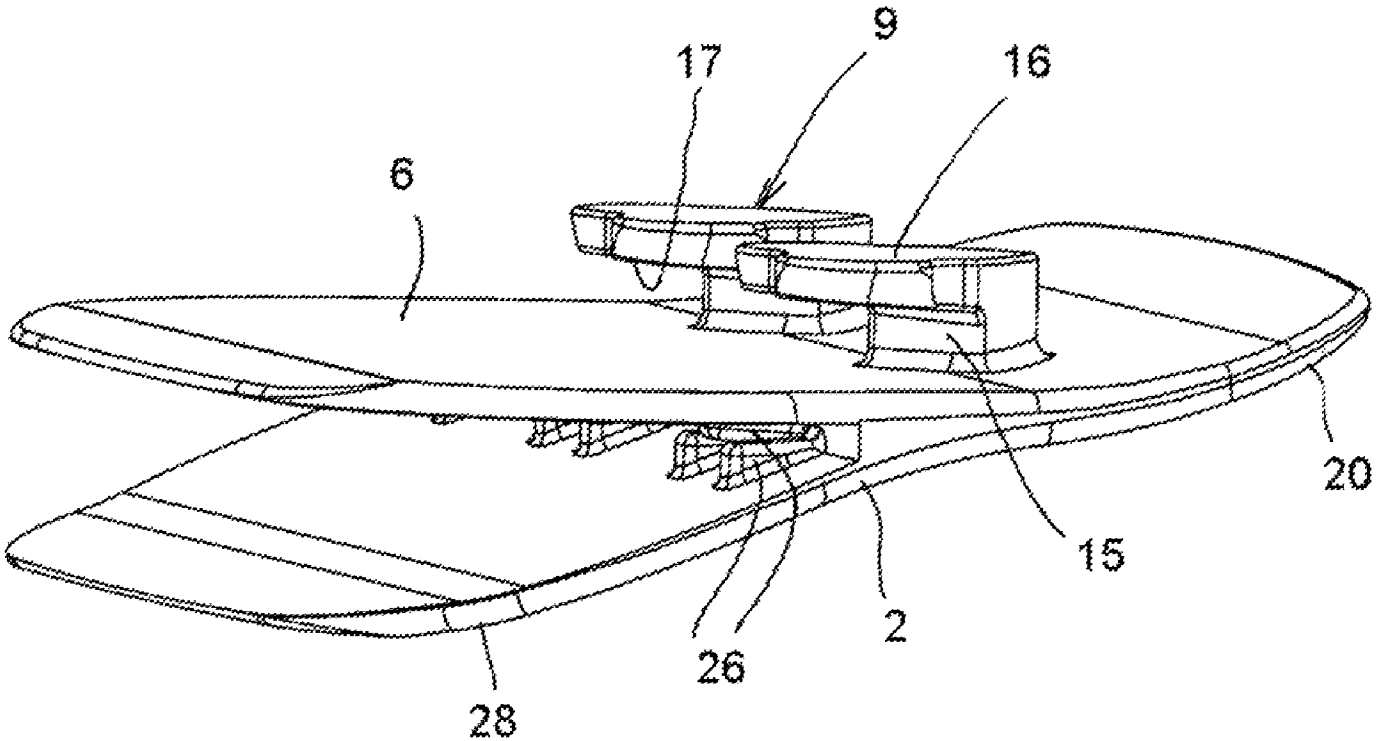
FIG. 7 is a more detailed perspective view of a component.
Figure 8:
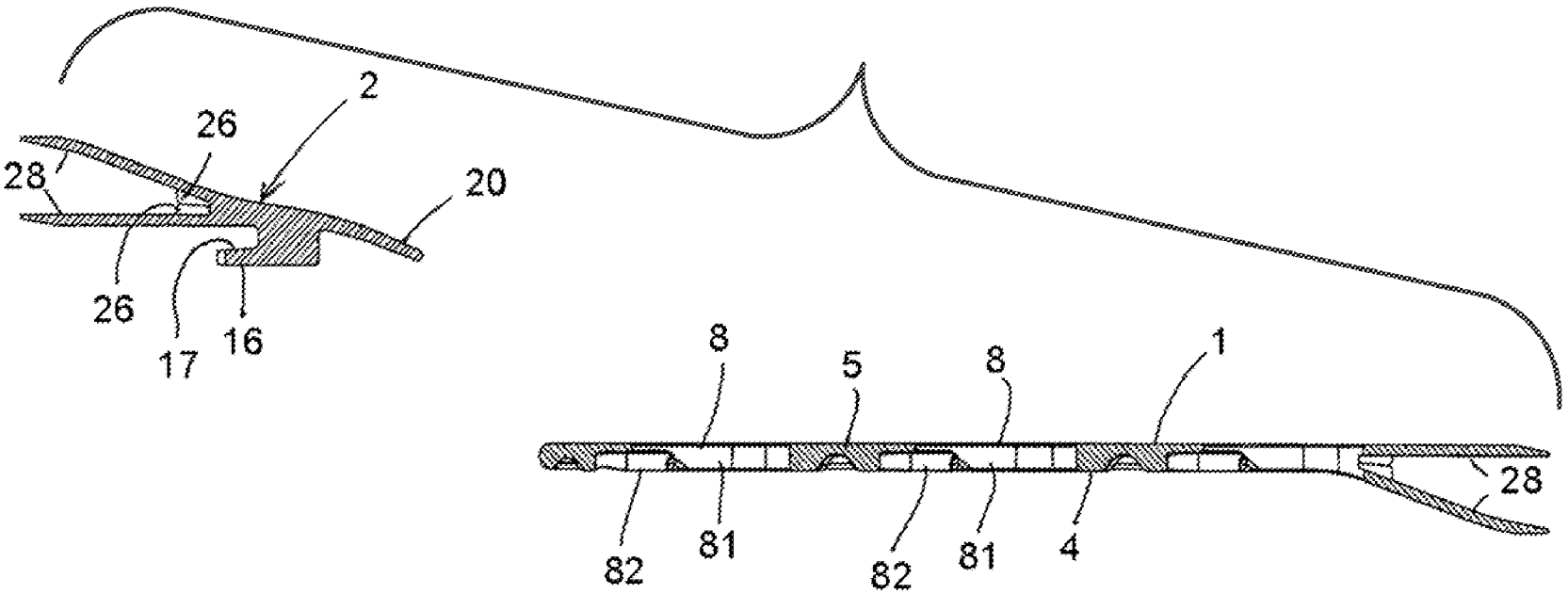
FIG. 8 is a section taken on a line A-A of the components of a fastening.

Referring to the drawings, each fastening comprises a first component 1 and a second component 2. The first component 1 is intended in use to lie flat against the body of the wearer of the garment and comprises a first thin, generally flat moulded plastic plate which has an inner side 4 and an outer side 5. The inner side 4 is partly contoured (shown only in FIG. 6) for flexibility, while the raised portions present a substantially flat aspect against the body of the wearer.

The second component 2 comprises a thin, contoured moulded plastic plate which has an inner side 6 and an outer side 7.

The first and second components have substantially flat or smoothly contoured surfaces and all edges are curved, so as to lie flat against the body of the wearer for comfort and to provide a smooth contoured outer face to lie inconspicuously under clothing. Each component is also injection moulded as a single piece.

In the embodiment of FIGS. 1 to 9 the first plate 1 is formed with two rows of three connecting recesses 8 extending from its outer side 5 to its inner side 4 and the second plate 2 is formed with two complementary connecting protrusions 9 on its inner side 6. Any number of recesses and rows of recesses may be provided. Similarly the second plate can be provided with a complementary number of connecting protrusions. Each recess 8 comprises an open portion 81 which permits access by a protrusion and a covered portion 82 which locates and holds the protrusion in use.

The inner and outer surfaces of both components, but excluding the inner surfaces of the jaws 28 described below, may be covered in a layer of flock to provide additional softness for the wearer and improve feel. In the embodiment shown the outer face of the recess is heart shaped to provide an aesthetically pleasing aspect, but it could also be oval, triangular, D-shaped, round, or any similar shape. The inner face of the first plate has a raised area 10 surrounding each recess 8 (shown in FIG. 6). These raised areas define the nominal thickness of the plate and are themselves surrounded and separated from each other by areas 11 of reduced thickness. The raised areas provide strength where the components engage. An additional ridge 12 at the periphery provides comfort whilst the substantially thinner cross section elsewhere allows flexibility for comfort in movement. The raised areas present a sufficiently flat aspect to lie comfortably against the back of the wearer. The covered portions 82 of the recesses are U-shaped or flat D-shaped and the surrounding wall of these portions is provided by a portion 101 of the surrounding raised area 10.

The U-shaped wall or ridges 101 act as a guide and end stop for the protrusions, and add strength. The peripheral ridge 12 acts to increase the effective thickness of the edges of the plate, proving increased comfort in wear.

The connecting protrusion on the second component is also heart shaped in plan for aesthetic reasons, and is complementary to the recess shape. The protrusion comprises a riser 15 and a plate 16 which acts as a hook. The hook is dimensioned to fit closely inside the U-shaped covered portion 82 of a recess. The hook is chamfered to avoid sharp edges which could cause injury or snagging to other clothing. The upper face 17 of the hook 16 is angled relative to the corresponding inner face of plate 1 so as to assist in engagement to minimise and counteract the tendency for the plates to separate when under tension on the garment in wear. The angle on the face 17 is such that the hook is slightly thicker at its junction with the riser than at its other end.

A slight restriction caused by beads 18 formed at either side of the junction between the open and covered portions of the recesses 8 enable the hooks 16 to have a slight snap fit feel as they enter the covered portions. This enhances the security of the connection and also improves user confidence in the connection.

Figure 9:
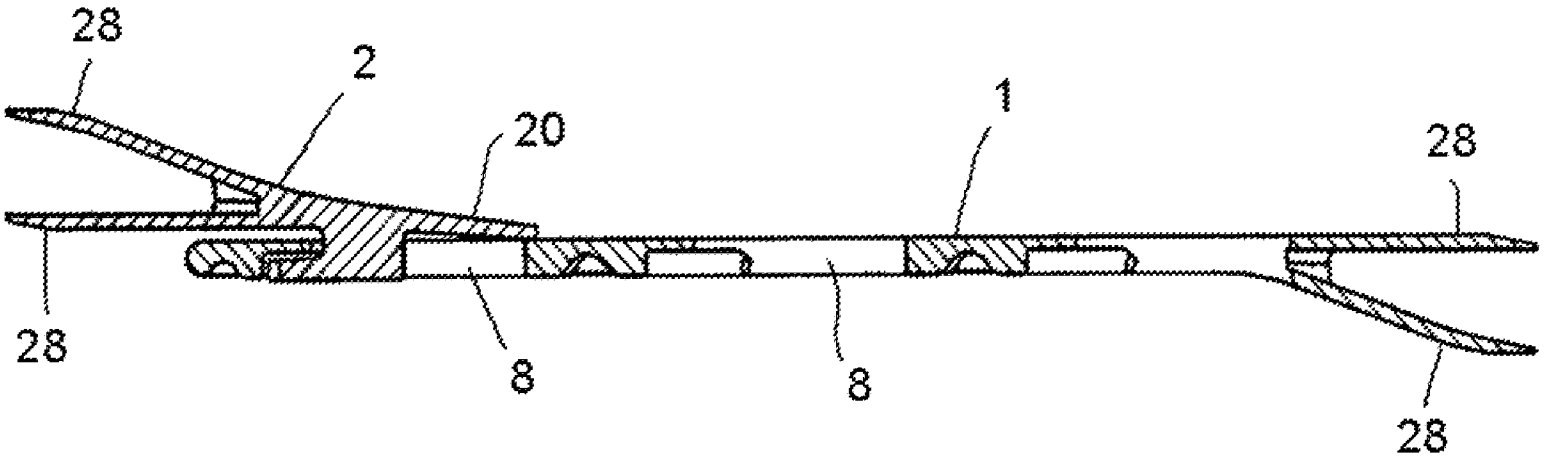
FIG. 9 is a section through the components coupled together.

The contoured angle of slope on the second component 2 eliminates the bulge shown through thin fitted outer garments. As can be seen best in FIG. 8, the nose portion 20 is inclined downwardly in a smooth curve from its outer side towards it inner side. The nose 20 is sloped at an angle greater than required for the difference in the thickness of the two components of the fastener to compensate for the 'lift' under tension to make the fastening inconspicuous under clothing. The nose 20 is also slightly thinned along its length and deflects resiliently when the components are coupled to bear resiliently against the outer side of the first plate as shown in FIG. 9.

When the components are engaged each hook 16 lies under the covered portion 82 of the recess with its outer edge flush against the ridge 101. In this position the second component 2 will at least partially overlie the outer side 3 of the first component 1. The outer surface of plate 1 and the inner surface of plate 2 lie substantially flat against one another. The outer side of the second component is smoothly contoured so there are no parts protruding.

The periphery of plates 1 and 2 may be formed with a wavy or scalloped edge with rounded corners. This makes the fastening softer to wear. Each plate is formed by a moulding operation. Each plate is formed with a pair of open jaws 28 for receiving the back panel, wing or strap of the garment. The jaws are flared for ease of attachment, but will be closed, at least partially, after connection to the garment. The jaws are constructed such that at least one jaw of each of either of the male and the female part may be allowed to be hinged by virtue of a thinning of the construction at one or more points, allowing the jaw or jaws to fold open enabling application of adhesive for the heat-bonding process subsequent to the manufacture of the fastener, which is one of the methods by which the components can be attached to the side panels of a brassiere. This method of attachment to the garment allows a superior join between the fastening and the garment which is flatter and smoother than all other methods of attachment.

A plurality of struts 26 provided on the inside of each of the jaws add strength whilst minimising the material content of the fastening to help maximise flexibility. Additionally the struts are collapsible, that is, they intermesh with one another, again increasing the flexibility, but also allowing the jaws to close to the minimum thickness possible when bonded to the garment side panel, so optimising the slimness and smoothness of that part of the garment. The struts also act as a stop for the fabric of the end of the garment (not shown).

The invention claimed is:

1. A fastening device comprising:

a first component being a female component and a second component being a male component, each component being adapted for attachment to a back panel, wing or strap of a garment, wherein the first component comprises: a plastic first plate which has an inner side and an outer side;

wherein the second component comprises a plastic second plate which has an inner side and an outer side adapted to at least partially overlie the outer side of the first plate in use;

wherein the first plate is formed with a plurality of connecting recesses, and wherein the inner side of the second plate is formed with at least one connecting protrusion adapted to be releasably received and retained selectively in at least some of the connecting recesses of the first plate; and wherein the second plate is formed with a resilient nose which is inclined downwardly in the direction from its outer side toward its inner side and is deflected upwardly when the components are coupled together to bear resiliently against the outer side of the first plate.

2. The fastening device as claimed in claim 1, wherein the nose of the second plate is thinned along its length.

3. The fastening device as claimed in claim 2, wherein the inner face of the first plate has a raised area surrounding each recess, and wherein the raised areas have areas of reduced thickness therebetween.

4. The fastening device as claimed in claim 2, wherein the recesses each comprise an open portion and a covered portion and the surrounding wall of at least the covered portions is provided by a raised area surrounding the recess.

5. The fastening device as claimed in claim 1, wherein each component is formed with a pair of jaws for receiving the back panel, wing, or strap of a garment.

6. The fastening device as claimed in claim 5, wherein a plurality of struts is provided on the inside of each jaw, the struts intermeshing with one another when the jaws are closed for bonding to a garment panel.

7. The fastening device as claimed in claim 6, wherein the inner face of the first plate has a raised area surrounding each recess, and wherein the raised areas have areas of reduced thickness therebetween.

8. The fastening device as claimed in claim 6, wherein the recesses each comprise an open portion and a covered portion and the surrounding wall of at least the covered portions is provided by a raised area surrounding the recess.

9. The fastening device as claimed in claim 5, where at least one jaw of each pair of jaws is thinned at one or more points to provide a hinge allowing the jaws to fold open.

10. The fastening device as claimed in claim 9, wherein the inner face of the first plate has a raised area surrounding each recess, and wherein the raised areas have areas of reduced thickness therebetween.

11. The fastening device as claimed in claim 9, wherein the recesses each comprise an open portion and a covered portion and the surrounding wall of at least the covered portions is provided by a raised area surrounding the recess.

12. The fastening device as claimed in claim 5, wherein the inner face of the first plate has a raised area surrounding each recess, and wherein the raised areas have areas of reduced thickness therebetween.

13. The fastening device as claimed in claim 5, wherein the recesses each comprise an open portion and a covered portion and the surrounding wall of at least the covered portions is provided by a raised area surrounding the recess.

14. The fastening device as claimed in claim 1, wherein the inner and outer surfaces of both components, are covered in a layer of flock.

15. The fastening device as claimed in claim 14, wherein the inner face of the first plate has a raised area surrounding each recess, and wherein the raised areas have areas of reduced thickness therebetween.

16. The fastening device as claimed in claim 14, wherein the recesses each comprise an open portion and a covered portion and the surrounding wall of at least the covered portions is provided by a raised area surrounding the recess.

17. The fastening device as claimed in claim 1, wherein the inner face of the first plate has a raised area surrounding each recess, and wherein the raised areas have areas of reduced thickness therebetween.

18. The fastening device as claimed in claim 17, wherein the recesses each comprise an open portion and a covered portion and the surrounding wall of at least the covered portions is provided by a raised area surrounding the recess.

19. The fastening device as claimed in claim 1, wherein the recesses each comprise an open portion and a covered portion and the surrounding wall of at least the covered portions is provided by a raised area surrounding the recess.

20. A fastening device comprising:

a first component and a second component, the first component being a female component and the second component being a male component, each component being adapted for attachment to a back panel, wing or strap of a garment, wherein the first component comprises a first plate which has an inner side and an outer side;

wherein the second component comprises a second plate which has an inner side and an outer side adapted to at least partially overlie the outer side of the first plate in use;

wherein the first plate is formed with a plurality of connecting recesses, and wherein the inner side of the second plate is formed with at least one connecting protrusion adapted to be releasably received and retained selectively in at least some of the connecting recesses of the first plate; and wherein the second plate is formed with a resilient nose which is thinned along its length and which is inclined downwardly in the direction from its outer side toward its inner side and is deflected upwardly when the components are coupled together to bear resiliently against the outer side of the first plate, and wherein each component is formed with a pair of jaws, and wherein a plurality of collapsible struts is provided on the inside of each jaw, at least some of the struts intermeshing with one another when the jaws are closed.

* * * * *